US005331377A

United States Patent [19]

Matsuura et al.

[11] Patent Number: 5,331,377

[45] Date of Patent: Jul. 19, 1994

[54] TONER SUPPLEMENT CONTROL DEVICE OPERATIVE CONCURRENT WITH IMAGE FORMING APPARATUS ACTIVE STATUS

[75] Inventors: Yozo Matsuura, Tokyo; Toshiyuki Nakama, Atsugi, both of Japan

[73] Assignee: Ricoh Company, Ltd., Tokyo, Japan

[21] Appl. No.: 976,502

[22] Filed: Nov. 13, 1992

[30] Foreign Application Priority Data

| | | | |
|---|---|---|---|
| Nov. 14, 1991 | [JP] | Japan | 3-299052 |
| Nov. 29, 1991 | [JP] | Japan | 3-315112 |
| May 14, 1992 | [JP] | Japan | 4-121943 |

[51] Int. Cl.[5] ..... G03G 21/00

[52] U.S. Cl. ..... 355/208; 355/246

[58] Field of Search ..... 355/203, 204, 208, 246, 355/209, 260; 222/DIG. 1; 118/689, 690, 691

[56] References Cited

U.S. PATENT DOCUMENTS

| | | | |
|---|---|---|---|
| 4,660,960 | 4/1987 | Fukunaga et al. | 222/DIG. 1 X |
| 4,963,940 | 10/1990 | Nemoto et al. | 222/DIG. 1 X |
| 5,036,363 | 7/1991 | Iida et al. | 355/246 |
| 5,095,331 | 3/1992 | Takano | 355/203 |

FOREIGN PATENT DOCUMENTS

| | | |
|---|---|---|
| 64266 | 5/1980 | Japan . |
| 235174 | 11/1985 | Japan . |

*Primary Examiner*—Benjamin R. Fuller
*Assistant Examiner*—J. E. Barlow, Jr.
*Attorney, Agent, or Firm*—Oblon, Spivak, McClelland, Maier & Neustadt

[57] ABSTRACT

A toner supplement control device incorporated in an image forming apparatus for executing the supplement of a fresh toner to a developing unit only when a particular document image process mode is under way. The particular process mode is any one of a document image receive mode, a document image record mode, a document image copy mode, a supervisory report record mode, etc. In the event of initialization of the apparatus, during ordinary recording operation, and when a cleaner and toner magazine (CTM) is to be replaced, whether or not a fresh toner is present in the CTM is determined on the basis of the condition of a fresh toner existing in a developing unit.

11 Claims, 10 Drawing Sheets

| Fig.6A |
| --- |
| Fig.6B |

START
S300
COMPLETED PROCESSING AFTER RAM CLEARING ?
NO
S301
TO FIG. 5
YES
S302
LED FLASHING OR REMAINING TURNED ON ?
NO
S303
HOLD CURRENT STATE
YES
S304
CTM SET ?
NO
S305
HOLD INHIBITION LED ON
YES
S306
TURN ON INHIBITION LED
S307
DETERMINE WHETHER OR NOT TONER IS PRESENT IN DEVELOP UNIT (SET ROTATION OF MAIN MOTOR FOR 6 SEC)

TONER SUPPLEMENT CONTROL DEVICE OPERATIVE CONCURRENT WITH IMAGE FORMING APPARATUS ACTIVE STATUS

BACKGROUND OF THE INVENTION

1. Field of the Invention

The present invention relates to a device incorporated in an electrophotographic copier, facsimile transceiver, laser beam printer or similar image forming apparatus for controlling the supplement of a toner. More particularly, the present invention is concerned with a toner supplement control device for effecting the automatic supplement of a fresh toner from a toner case to a toner hopper only during a particular document image process mode operation in response to a toner near end signal from a toner near end sensor associated with the toner hopper.

2. Discussion of the Background

An image forming apparatus of the kind described is usually constructed such that when a toner stored in a toner hopper of a developing unit for developing a latent image electrostatically formed on a photoconductive element becomes short, a toner near end sensor detects the shortage. As the sensor generates a toner near end signal, a fresh toner is automatically supplemented from a toner casing storing it to the toner hopper. Stated another way, even when a copier has ended operating in a copy mode, a facsimile transceiver has ended operating in a receive mode and in a supervisory report output mode, or a laser beam printer has ended operating in a record mode, the fresh toner is immediately supplemented in response to the toner near end signal. This not only causes the operator of such an apparatus to feel uneasy but also generates unpleasant noise.

On the other hand, a toner magazine for feeding a fresh toner to the developing unit and a toner magazine for collecting a toner removed from a photoconductive element have customarily been mounted on the body of an image forming apparatus independently of each other. A disposable cleaner and toner magazine (CTM) is an implementation recently proposed to promote easy maintenance and reduce running cost. The CTM has the above-mentioned two toner magazines combined back-to-back in an integral construction. The prerequisite with the CTM is that whether or not a fresh toner is present in the CTM be determined at all times to see a time for replacement and to see if the magazine newly mounted is really new. However, since the CTM is a disposable unit, providing it with a toner sensor which is expensive for sensing a toner in the CTM is wasteful.

SUMMARY OF THE INVENTION

It is, therefore, an object of the present invention to provide a toner supplement control device incorporated in an image forming apparatus for executing the automatic supplement of a fresh toner to a developing unit only when a particular document image process mode operation is under way, thereby freeing the operator from uneasy feelings while eliminating noise.

It is another object of the present invention to provide a device for determining whether or not a fresh toner is present in a CTM.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
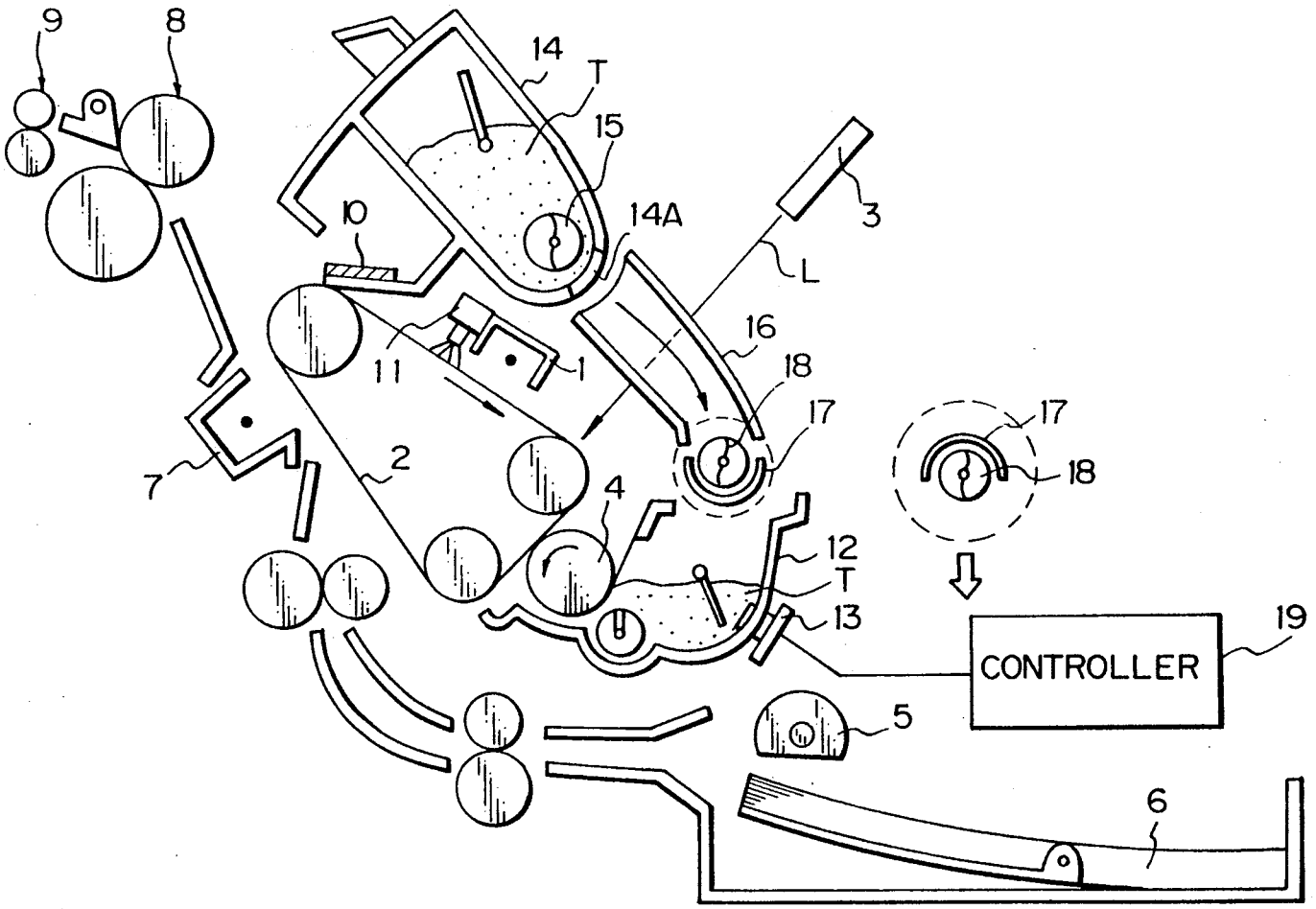
FIG. 1 is a fragmentary view of an image forming apparatus to which the present invention is applicable and implemented as a laser beam printer by way of example.

Referring to FIG. 1 of the drawings, an image forming apparatus to which the present invention is applicable is shown and implemented as a laser beam printer. As shown, the printer has a photoconductive element in the form of a belt 2, a main charger 1 for uniformly charging the belt 2 to a predetermined polarity, and an optical writing unit 3 for scanning the charged belt 2 with a laser beam L to form an electrostatic latent image. A developing roller 4 is included in a developing unit to deposit a toner T on the scanned portions of the belt 2, thereby converting the latent image to a toner image. A transfer charger 7 transfers the toner image from the belt 2 to a recording medium, e.g., a paper 6 fed by a pick-up roller 5. A fixing roller pair 8 fixes the toner image on the paper 6, and then a discharge roller pair 9 drives the paper 6 out of the printer. A cleaning blade 10 removes the toner remaining on the belt 2 after the image transfer, and then a discharge lamp 11 dissipates the charge also remaining on the belt 2.

A toner near end sensor 13 is associated with a toner hopper 12 which is included in the developing unit. Assume that the toner near end sensor 13 has generated, while the above recording process is under way, a toner near end signal indicating that the toner T is in a near end condition. On receiving the toner near end signal, a controller 19 rotates a screw 15 disposed in a toner case 14 storing a fresh toner therein. As a result, the toner T is driven out of the toner case 14 through an opening 14A and then let fall onto a toner receiver 17 via a duct 16. A screw 18 conveys the toner fallen onto the toner receiver 17 in a direction perpendicular to the sheet surface of FIG. 1. At a predetermined time when the toner T is to be uniformly accumulated on the toner receiver 17 in the above-mentioned direction, the receiver 17 is rotated 180 degrees to feed the toner to the toner hopper 12.

As stated above, it has been customary with the laser beam printer to supplement the toner T automatically from the toner case 14 to the toner hopper 12 via the duct 16 as soon as the toner near end sensor 13 generates a toner near end signal. Stated another way, even after the printer has completed an image forming operation thereof, the toner T is automatically supplied when the toner near end sensor 13 generates a toner near end signal. This not only causes the operator to feel uneasy but also constitutes a cause of unpleasant noise.

Figure 2:
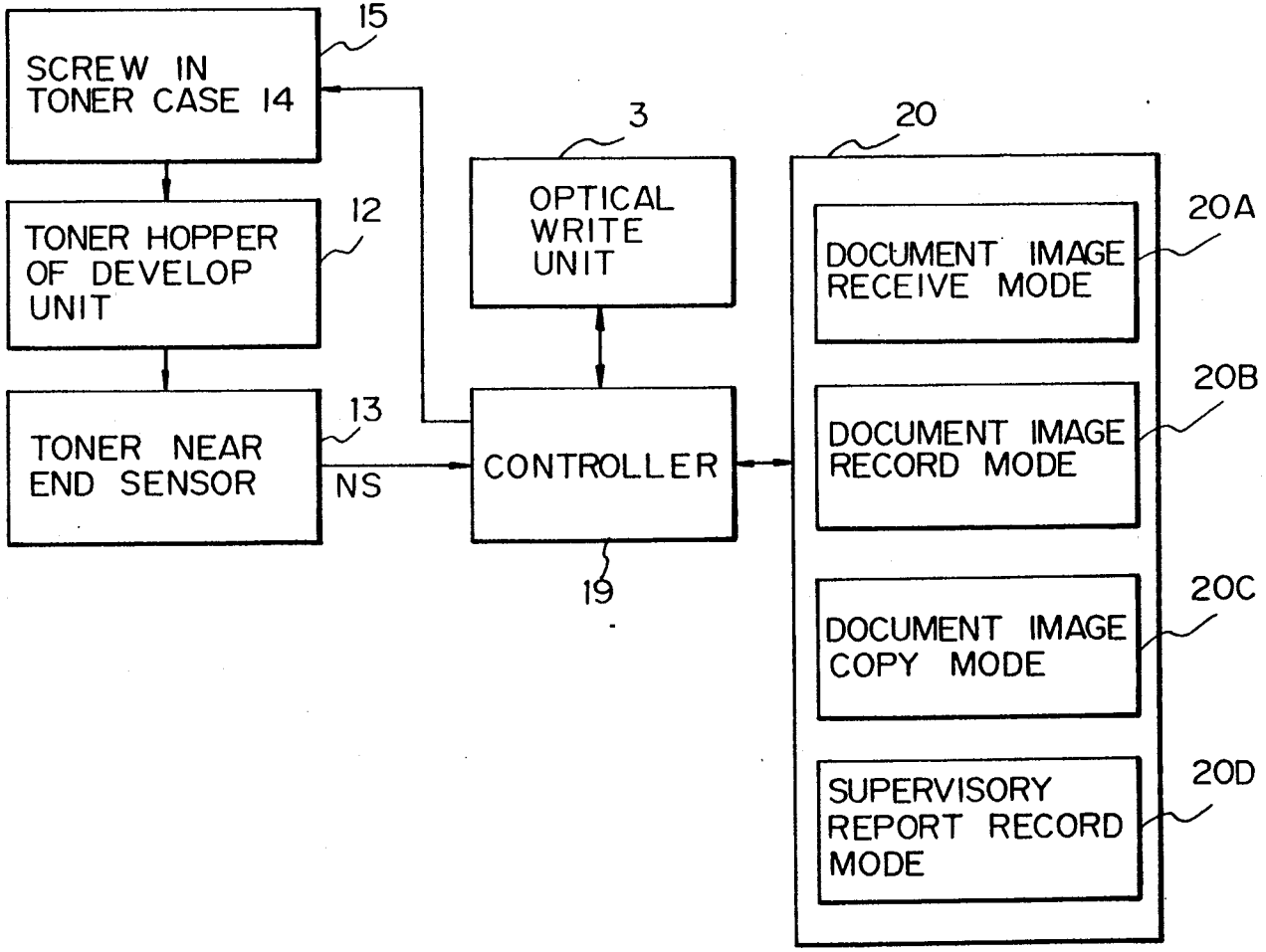
FIG. 2 is a block diagram schematically showing a toner supplement control device embodying the present invention.

FIG. 2 shows a toner supplement control device embodying the present invention and applied to the laser beam printer shown in FIG. 1. As shown, the control device has a controller 19 for controlling the entire printer. A decision section 20 discriminates a mode 20A in which a document image is received, a mode 20B in which a document image is recorded, a mode 20C in which a document image is copied, a mode in which a supervisory report, for example, is recorded, etc.

Figure 3:
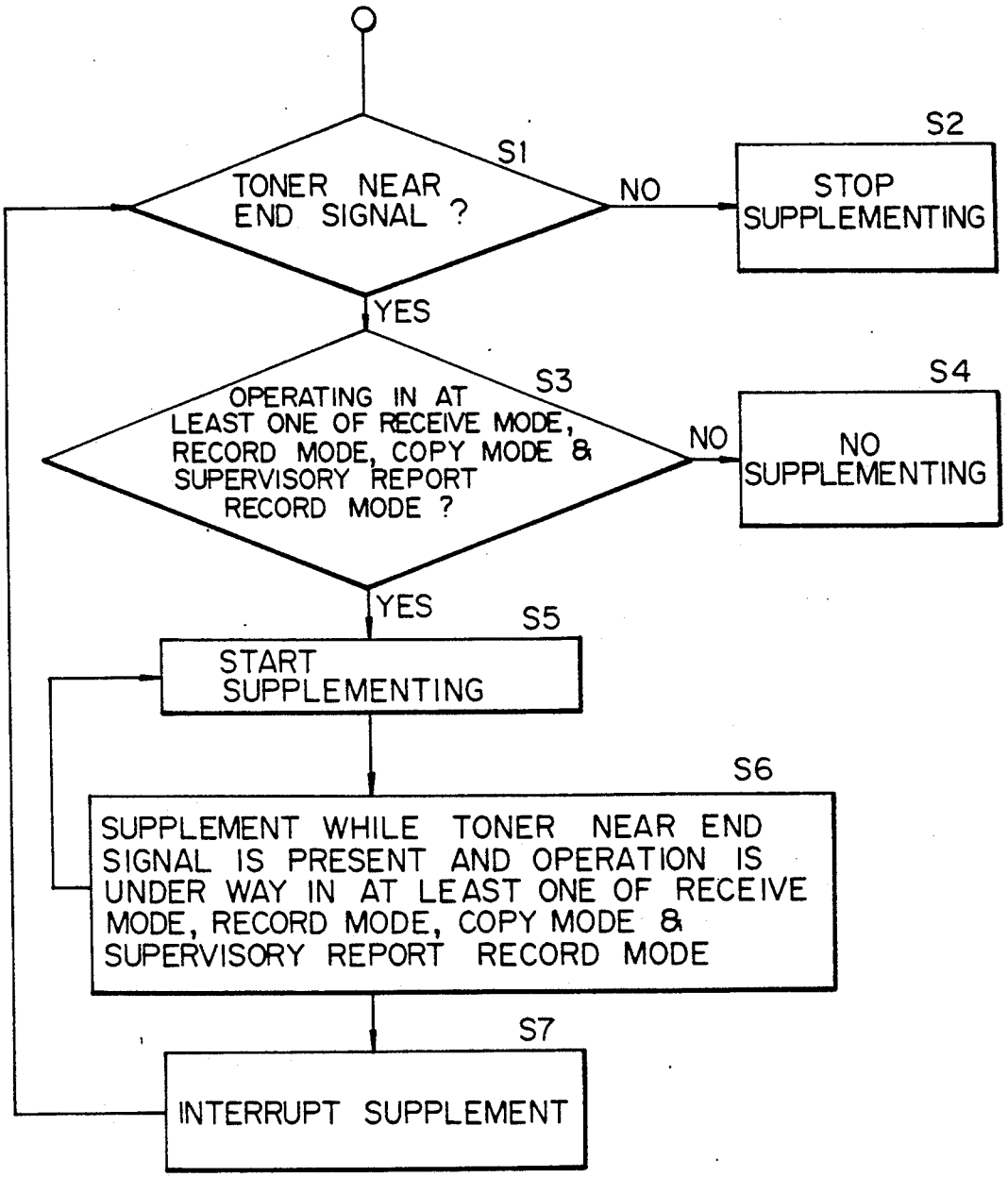
FIG. 3 is a flowchart demonstrating a toner supply control procedure particular to the embodiment.

A reference will be also made to FIG. 3 for describing a specific operation of the controller 19. First, the controller 19 determines whether or not the toner near end sensor 13 has generated a near end signal NS (step S1, FIG. 3). If the signal NS is absent (NO, S1), the controller 19 does not drive the screw 15 so as not to supplement the toner to the toner hopper (S2). If the signal NS is present (YES, S1), the controller 19 causes the decision section 20 to determine which of the document image receive mode 20A, document image record mode 20B, document image copy mode 20C and supervisory report record mode 20D is under way (S3). If none of such modes 20A–20D is under way (NO, S3), the controller 19 does not supplement the toner (S4). If at least one of the modes 20A–20D is under way (YES, S3), the controller 19 drives the screw 15 to start supplementing the toner (S5). As a result, the toner is fed from the toner case 14 to the toner hopper 12 until the NS signal disappears, i.e., until the toner near end sensor 13 stops detecting the near end condition (S6). When the operation in any one of the modes 20A–20D ends before the NS signal disappears, the controller 19 interrupts the toner supplementing operation (S7) and then returns to the step S1 to resume the control in matching relation to the next processing mode.

Figure 4:
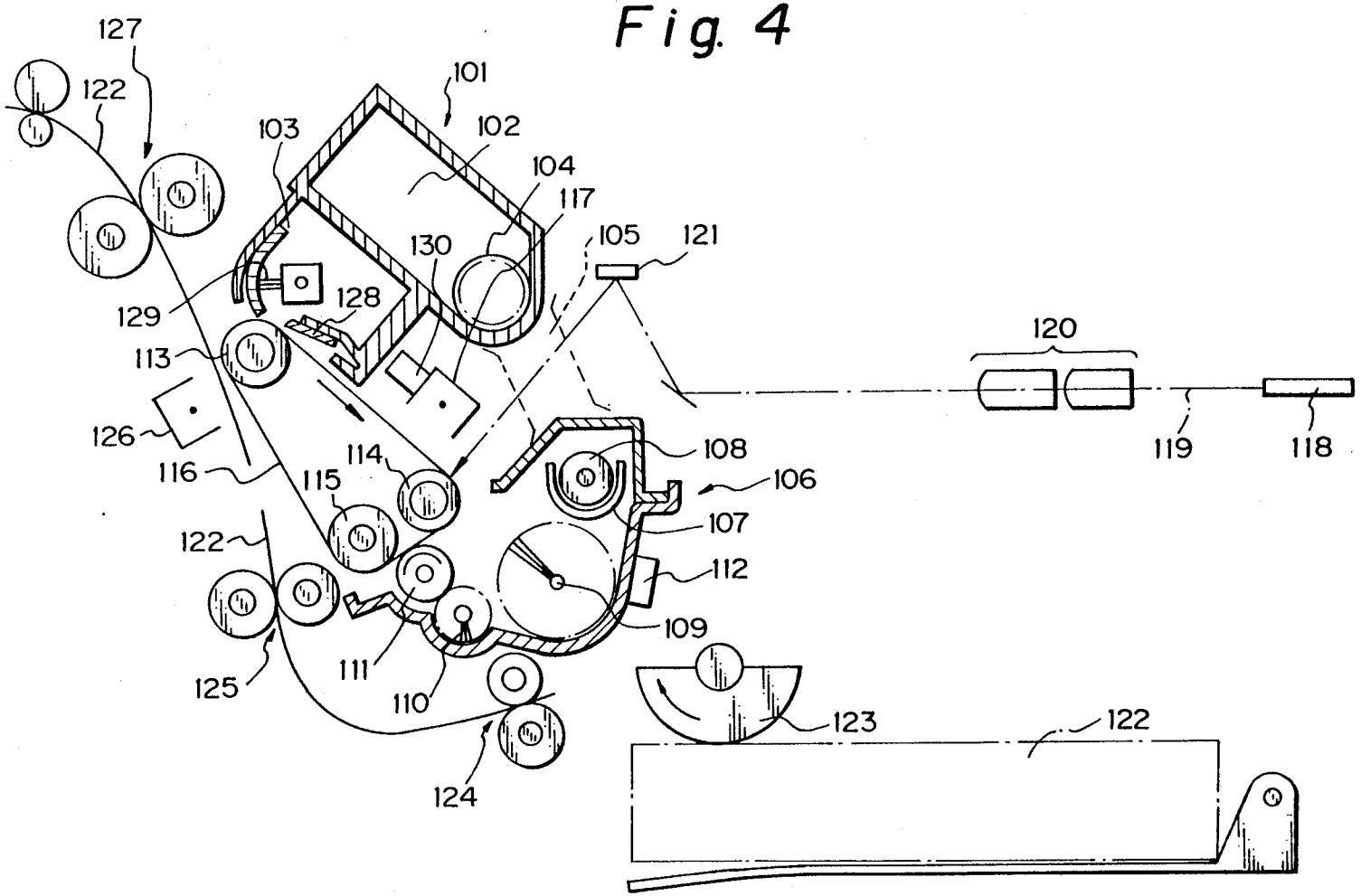
FIG. 4 is a section of an image forming apparatus to which a device for determining whether or not a toner is present in a CTM in accordance with the present invention is applied.

FIG. 4 shows an image forming apparatus of the type including a cleaner and toner magazine (CTM) and implemented as a plotter for a facsimile transceiver by way of example. As shown, a CTM, generally 101, is a combination of a toner magazine 102 storing a fresh toner and a toner magazine 103 for collecting a used toner. The two toner magazines 102 and 103 are joined back-to-back with each other. A screw 104 is disposed in the toner magazine 102 and extends in a direction perpendicular to the sheet surface of FIG. 4. When the fresh toner should be supplemented, the screw 104 is rotated to move the toner to an outlet located at the viewer's side with respect to FIG. 4. As a result, the fresh toner is fed to a developing unit 106 via a duct 105. A CTM sensor, not shown, determines whether or not the CTM 101 is mounted on the apparatus body. It is to be noted that the CTM 101 is a disposable unit which is easy to replace.

A guide 107 having a generally U-shaped section and a screw 108 are accommodated in the developing unit 106. The toner fed from the toner magazine 102 is accumulated on the guide 107 while the screw 108 uniformizes the distribution of the toner on the guide 107. The guide 107 is rotated at a predetermined interval in synchronism with the rotation of the screw 104 to feed the toner to the developing unit 106. An agitator 109 is rotated to agitate the toner introduced in the developing unit 106. A toner supply brush 110 is also rotated to feed the toner toward a developing roller 111. A toner sensor 112 determines whether or not the toner is present in the developing unit 106. In the specific construction, the toner sensor 112 is implemented by a piezoelectric sensor. A photoconductive element in the form of a belt 116 is passed over rollers 113, 114 and 115 and driven in a direction indicated by an arrow in the figure. The developing roller 111 is held in contact with the belt 116 under a predetermined pressure and deposits the toner on the belt 116 while being rotated. A main charger 117 charges the belt 116 to a predetermined polarity by corona discharge.

A laser 118 emits a laser beam 119 representative of image data. The laser beam 119 scans the charged belt 116 via a lens unit 120 and a polygonal mirror 121 which is rotated by an exclusive motor, not shown. As a result, a latent image is electrostatically formed in a desired position on the belt 116. The developing roller 111 deposits the toner on the latent image formed on the belt 116 to thereby convert it to a toner image. A paper 122 is fed from a cassette by a semicircular pick-up roller 123 and then transported by a roller pair 124 and 125 to an image transfer station where a transfer charger 126 is located. The transfer charger 126 transfers the toner image from the belt 116 to the paper 122 as the paper 122 reaches the image transfer station. A fixing roller pair 127 fixes the toner image on the paper 122 by pressure and heat to produce a hard copy.

The other or used toner magazine 103 accommodates a cleaning blade 128 and a brush 129. While the cleaning blade 128 removes the toner remaining on the belt 116 after image transfer, the brush 129 in rotation collects the removed toner in the toner magazine 103. Discharge LEDs (Light Emitting Diodes) 130 dissipate the charge remaining on the belt 116 after image transfer.

The arrangement shown in FIG. 4 includes two independent drive lines, i.e., a first drive line for driving the screw 104 and guide 107 and a second drive line for driving all the other driven members by a main motor. A CPU (Central Processing Unit) for controlling the various sections of the apparatus, and memories (ROM and RAM) associated with the CPU are also incorporated in the apparatus, although not shown in the figure.

Figure 5A:
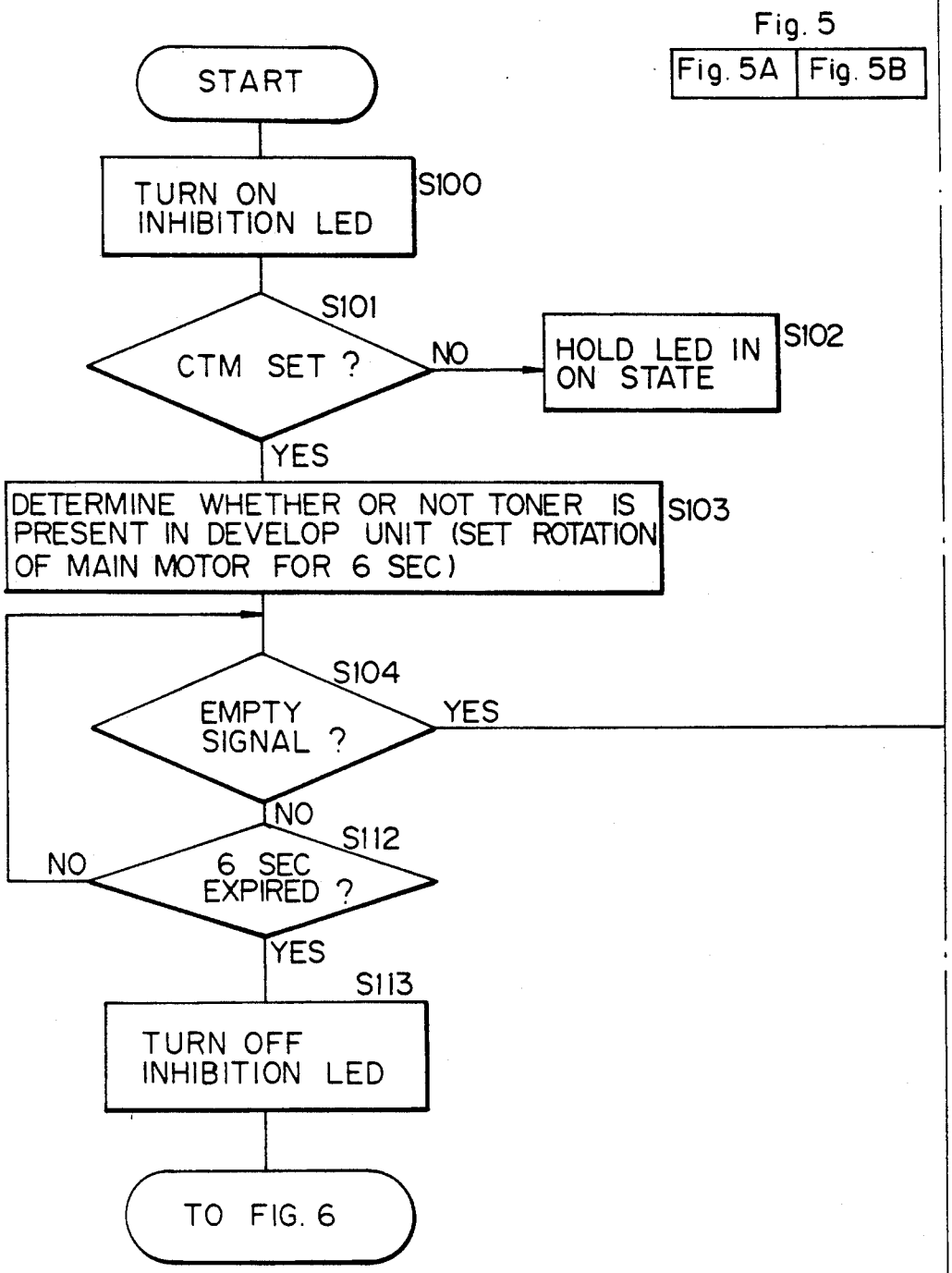
FIG. 5 is a flowchart representative of an initialize mode particular to the apparatus of FIG. 4.
Figure 5B:
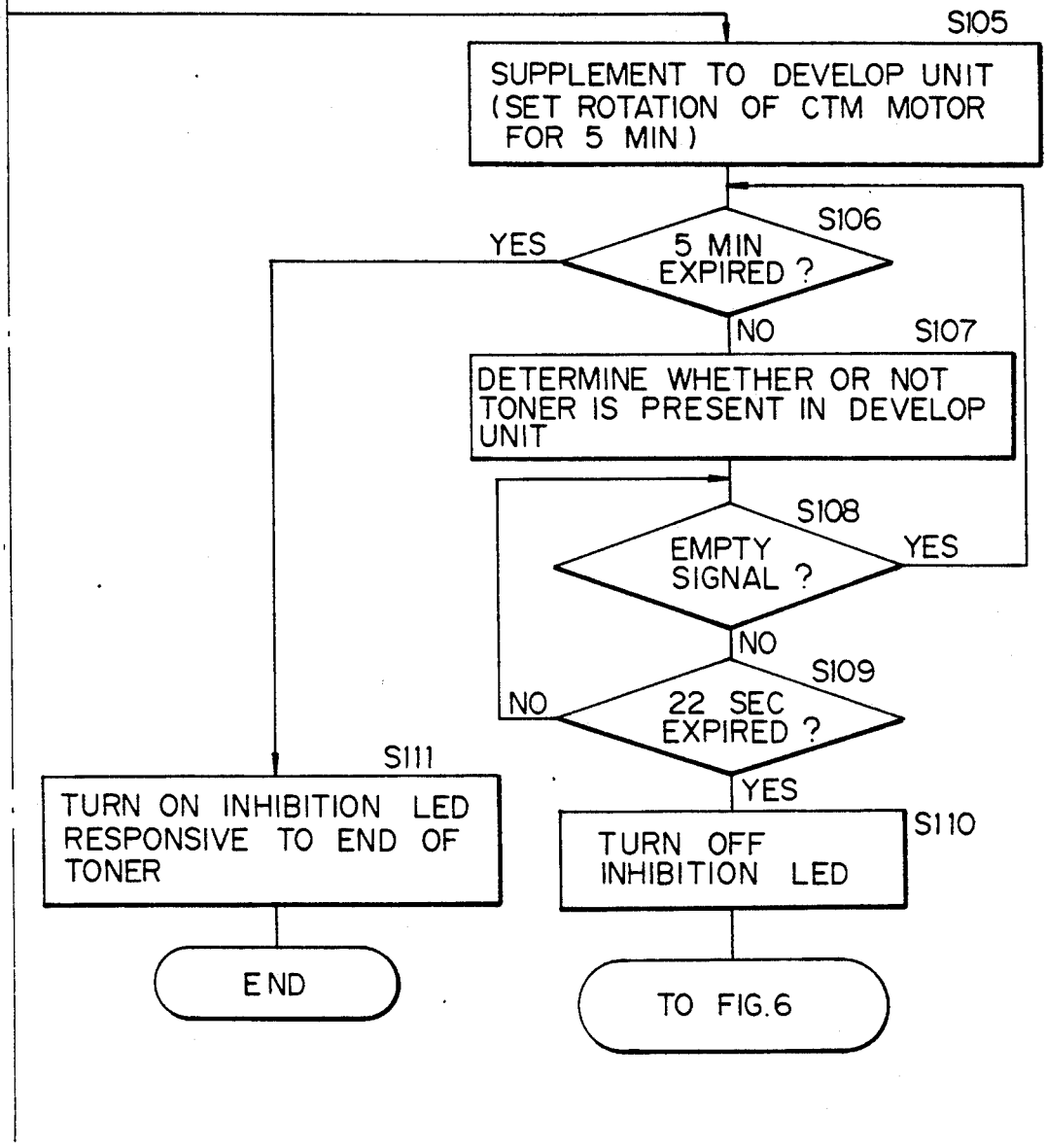

FIGS. 5A and 5B demonstrates an initialize mode operation of the apparatus shown in FIG. 4. As shown, when the apparatus is to be used for the first time, the apparatus is not loaded with a toner. Hence, an LED for inhibiting the operation of the apparatus is turned on (step S100). Then, a CTM sensor, not shown, determines whether or not the CTM 101 is mounted on the apparatus body (S101). If the CTM 101 is absent, the inhibition LED is continuously turned on (S102). If the CTM 101 is present, the toner sensor 112 determines whether or not a toner is present in the developing unit 106 (S103). In the illustrative embodiment, the toner sensor 112 performs a sensing operation in association with the rotation of the main motor included in the second drive line. Therefore, the main motor is rotated for a predetermined period of time (here, the period of time necessary for the sensing operation is 6 seconds).

If a toner is absent in the developing unit 106 as determined in a step S104 (usually, a toner does not exist at the time of initialization), a fresh toner is supplied to the empty developing unit 106 in a predetermined amount, i.e., for a predetermined period of time (S105). In the embodiment, the first drive line is driven for 5 minutes to supply a fresh toner from the CTM 101 to the developing unit 106 via the screw 104 and guide 107. Subsequently, whether or not 5 minutes has elapsed is determined by a timer or a counter (S106). If 5 minutes has not elapsed, the toner sensor 112 determines whether or not a toner exists in the developing unit 106 (S107) (here, about 22 seconds is necessary for the result of sensing to become stable). If a toner is absent as determined in a step S108, the program returns to the step S106. If a toner is present, the program waits for the above-mentioned period of time, i.e., 22 seconds.

By the above procedure, a fresh toner is surely supplied from the CTM 101 to the empty developing unit 106. Then, it is seen that the apparatus is ready to operate, and the CTM 101 mounted on the apparatus body is loaded with a fresh toner. Hence, in a step S110, the inhibition LED is turned off to allow an ordinary recording operation to be executed (see FIGS. 6A and 6B). If no toner is detected even after the toner supplementing operation has been continued over 5 minutes, the inhibition LED is turned on to indicate the end of toner (S111). This shows that the CTM 101 mounted on the apparatus body is not loaded with a fresh toner, a new CTM has to be mounted on the apparatus, and initialization has to be repeated.

Assume that an empty signal is not generated as determined in the step S104, the toner sensing operation is continued for 6 seconds. When the presence of toner is surely determined (YES, S112), it is seen that the toner has already been introduced in the developing unit 106. Therefore, in a step S113, the inhibition LED is turned off to allow an ordinary recording operation to be executed (see FIGS. 6A and 6B).

Figures 6, 6A:
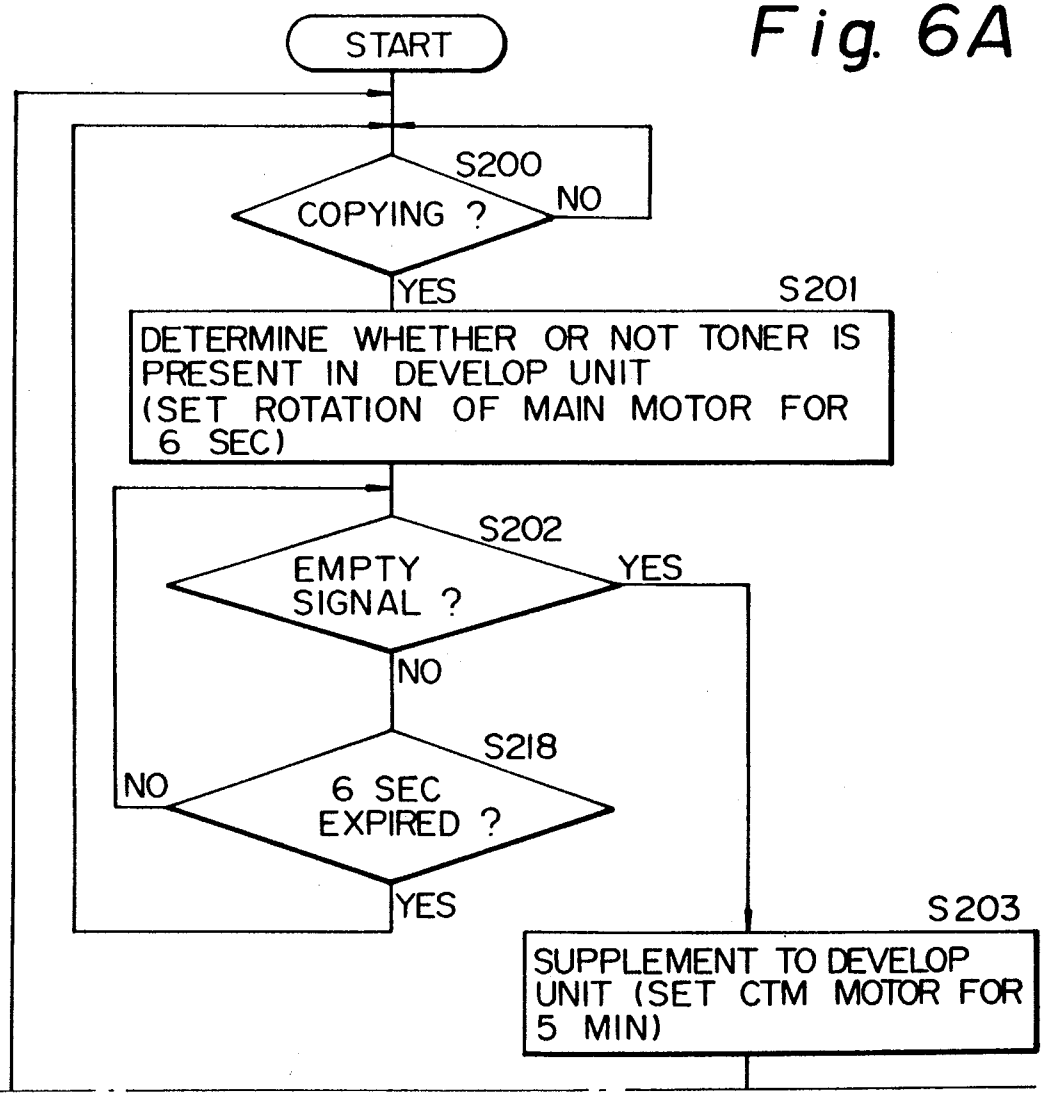
FIG. 6 is a flowchart representative of a record mode particular to the apparatus of FIG. 4.
Figure 6B:
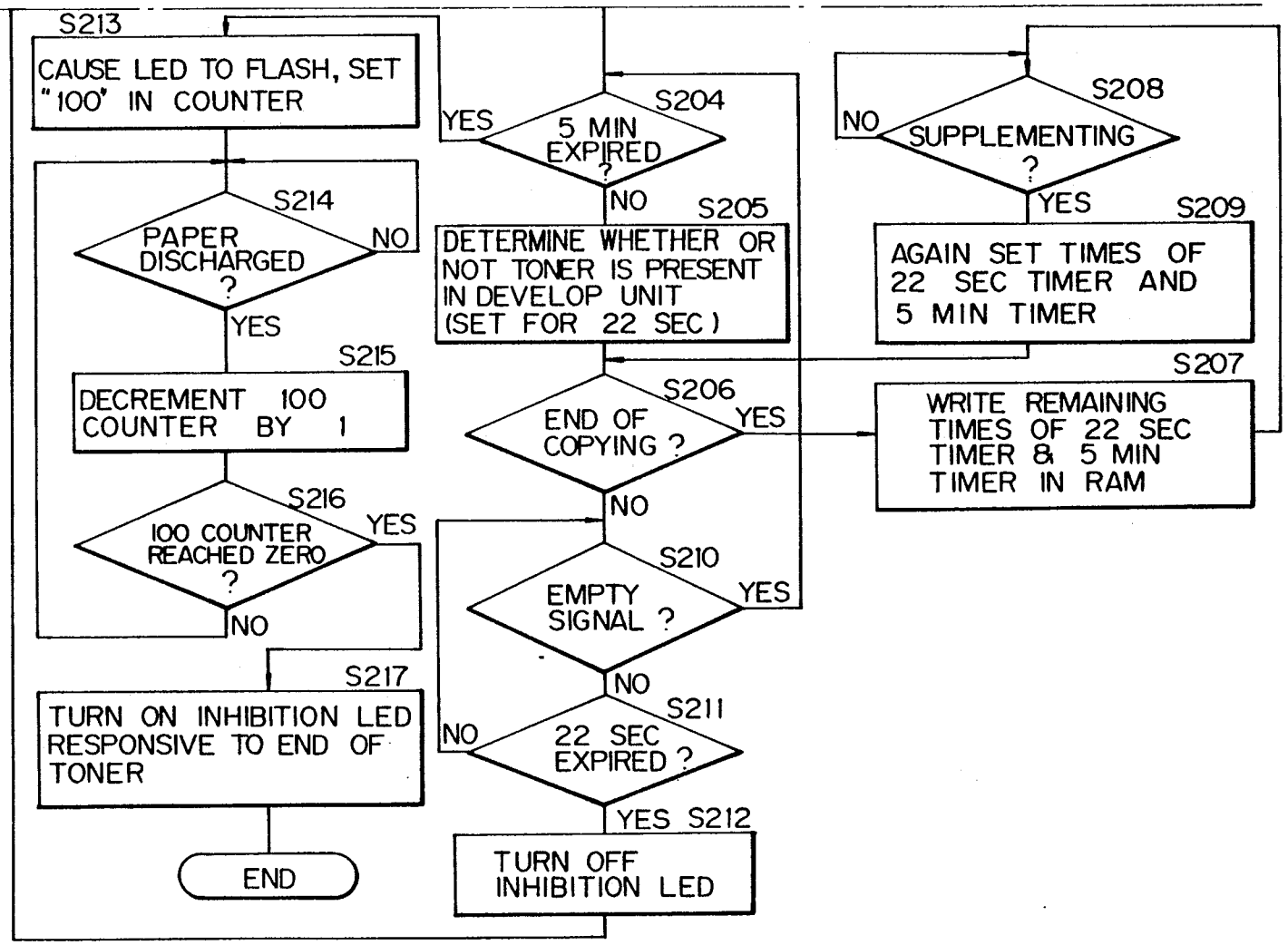

As shown in FIGS. 6A and 6B, a record mode operation begins after the initialize mode operation of FIGS. 6A and 6B, i.e., after the developing unit 106 has been loaded with a toner. First, whether or not a copying operation is under way is determined (S200). Only if such an operation is under way, the toner sensor 112 continuously determines whether or not a toner exists in the developing unit 106 for 6 seconds (S201). If a toner is absent in the developing unit 106, a fresh toner is supplemented in a predetermined amount for 5 seconds (S203). Then, whether or not 5 seconds has expired is determined by the timer or counter incorporated in the CPU (S204). If the answer of the step S204 is negative, the toner sensor 112 continuously determines whether or not a toner is present in the developing unit 106 for 22 seconds (S205). When the copying operation ends during the toner supplement (S206), the toner supplementing and toner sensing operation is interrupted while the remaining time of the 5 minutes timer and that of the 22 seconds timer are written to the RAM (S207). Subsequently, whether or not the toner supplement is resumed due to the start of another copying operation is determined (S208). On the start of toner supplement, the remaining times stored in the RAM as stated above are read out and again set in the respective timers (S209). As a result, the toner supplying and toner sensing operation is resumed. If the copying operation again ends during this toner supplement, the steps S207–S209 are repeated.

If a toner is absent in the developing unit 106 as determined during the copying operation (S210), the program returns to the step S204. If a toner is present (NO, S210), the program waits for 22 seconds in which the result of sensing will become stable, thereby surely confirming that a toner has been sensed. This shows that even when the developing unit 106 runs out of toner during a copying operation, a fresh toner still remains in the CTM 101 since a fresh toner has surely been supplemented to the developing unit 106. In a step S212, if the inhibition LED has been turned on, it is turned off, and then the program returns to the step S200.

Assume that a toner has not been sensed even after the 5 minutes of supplement to the developing unit 106 (step S204). Then, in a step S213, an LED indicative of the fact that a predetermined amount of fresh toner is left in the developing unit 106 although the CTM 101 is empty is caused to flash. At the same time, the number of papers which can be dealt with by the remaining toner (100 papers in the embodiment) is set in a counter. The flashing LED shows that although a recording operation can be performed, it is necessary to replace the CTM 101 so as to supplement a toner. As a result, the operator is urged to replace the CTM 101. Every time a paper which has undergone a copying operation is driven out of the apparatus, the 100 counter is decremented by one (S215). As the 100 counter reaches zero (S216), meaning that the developing unit 106 has also run out of toner, an LED indicative of the end of toner is turned on to inhibit a recording operation (S217). Such a condition informs the operator of the fact that the CTM 101 mounted on the apparatus body has run out of toner during the recording operation, and the developing unit 106 has also run out of toner. Further, if an empty signal is not generated in the step S202, the toner sensing operation is continued for 6 seconds to see if a toner is present (S218). Then, the program returns to the step S200 so as to repetitively determine whether or not a toner is present in the developing unit 106, so long as the copying operation is under way.

As stated above, since the illustrative embodiment effects toner supplement and toner sensing only during a copying operation, it prevents the facsimile apparatus from operating when transmission or reception is not under way. This is successful in preventing the operator from feeling uneasy. Moreover, the embodiment allows the recording operation to be continued with up to a predetermined number of papers even after the CTM 101 has run out of toner. This makes it needless to replace the CTM 101 strictly at a predetermined time, i.e., allows the operator to replace it at his or her convenience.

Figures 7, 7A, 7B:
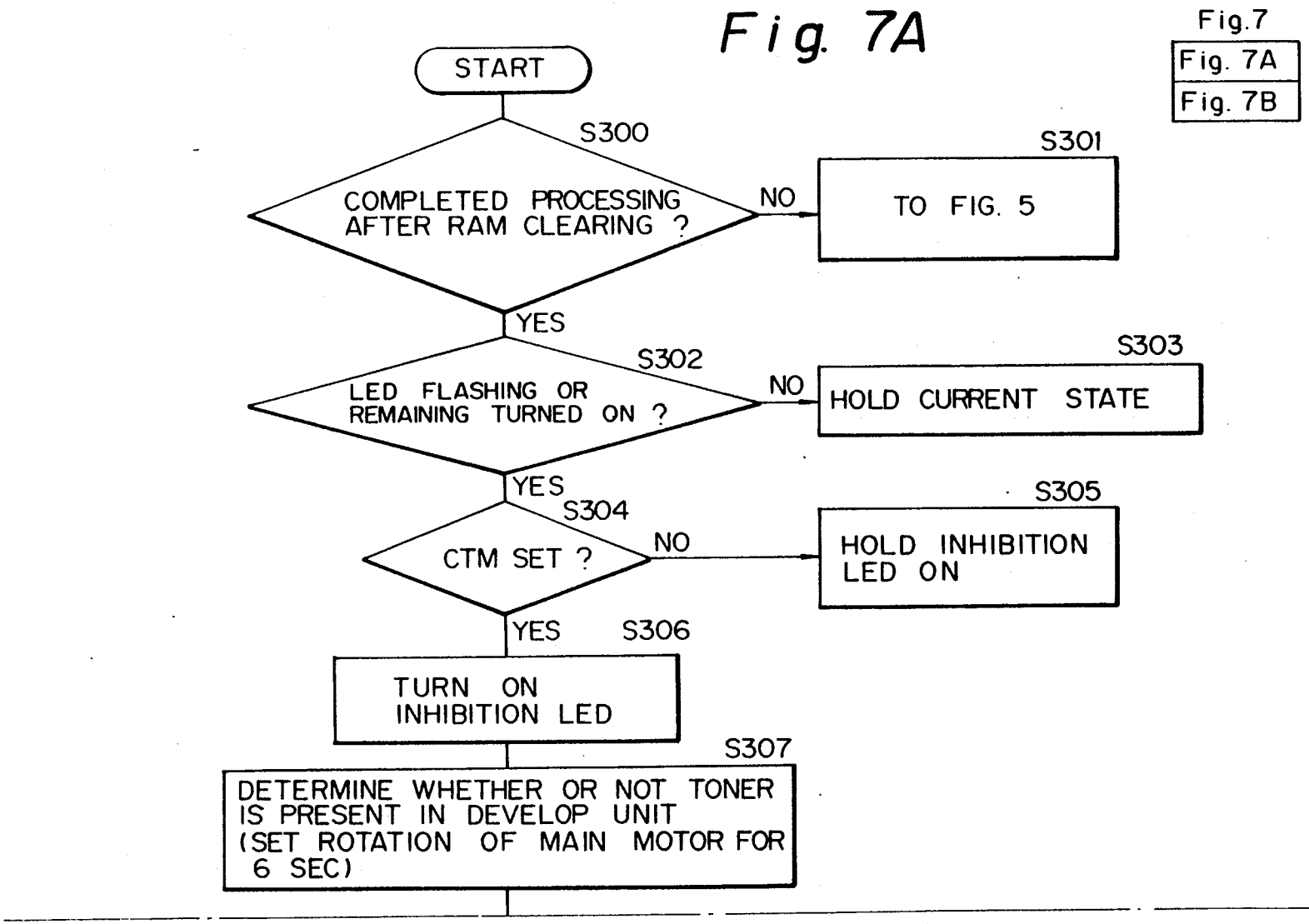
FIG. 7 is a flowchart representative of a CTM replace mode particular to the apparatus of FIG. 4.
Figure 7B:
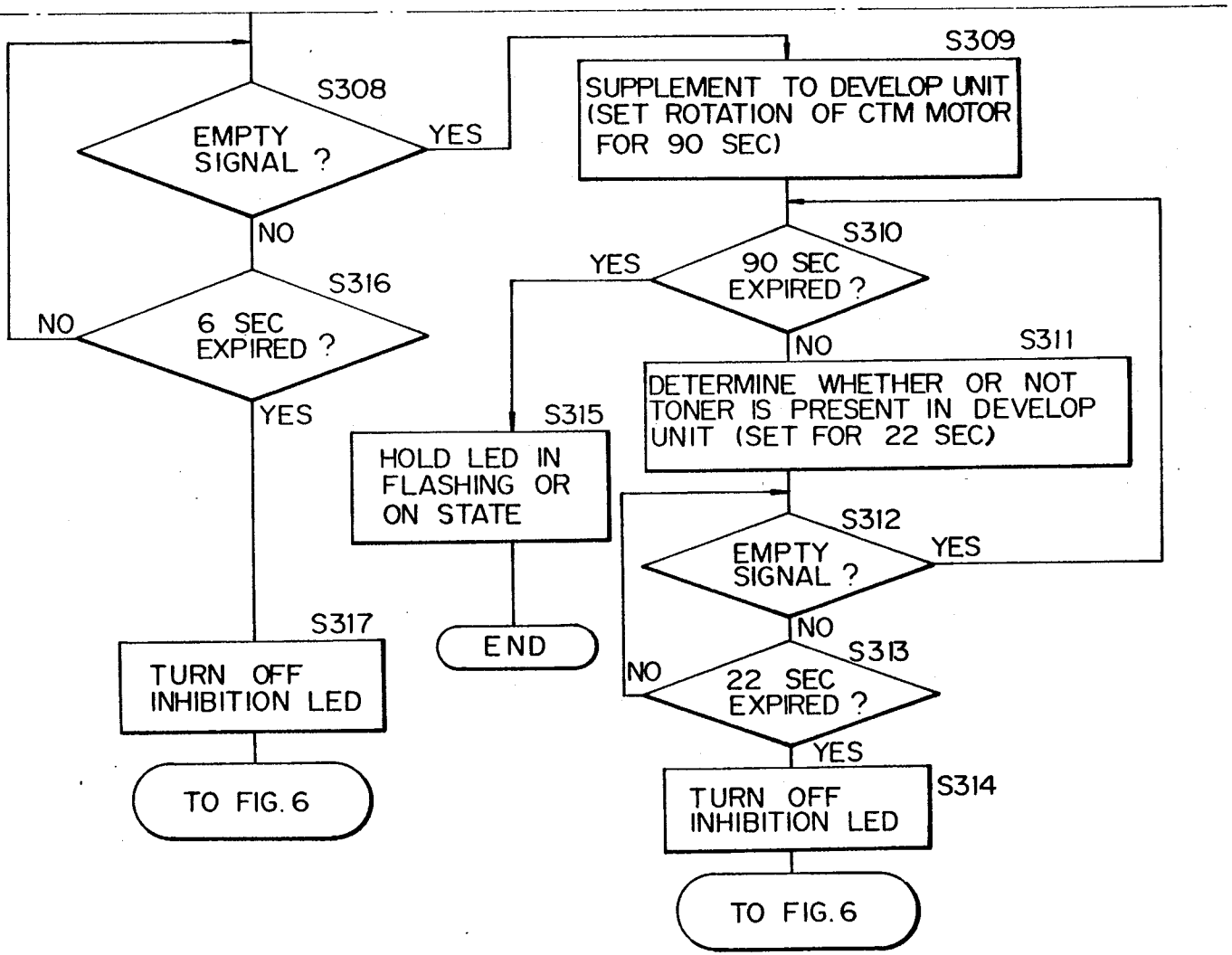

Referring to FIGS. 7A and 7B, a CTM replace mode operation is shown which follows the replacement of the CTM 101. As shown, if the initialization after the RAM has been cleared is not complete as determined in a step S300, the initialization described with reference to FIGS. 5A and 5B is executed (S301). If the answer of the step S300 is positive, the LEDs, if not flashing or turned on (S302), are held as they are since toner supplement is not necessary (S303). If the answer of the step S302 is positive, meaning that toner supplement is necessary, whether or not the CTM 101 has been set is determined (S304). If the CTM 101 has not been set, meaning that a toner cannot be supplemented, the inhibition LED is continuously turned on (S305).

If the CTM 101 has been set, the inhibition LED is turned on (S306), and then the toner sensor 112 is driven for 6 seconds to see if a toner is present in the developing unit (S307). If a toner is absent in the developing unit 106 as determined in a step S308, a toner supplementing operation is effected for 90 seconds (which is sufficient since some toner is left in the developing unit 106). Subsequently, whether or not 90 seconds has expired is determined by a timer or a counter built in the CPU (S310). If 90 seconds has not expired, the toner sensor 112 determines whether or not a toner is present in the developing unit 106 over 22 seconds (S311). If a toner is absent (S312), the program returns to the step S310; if otherwise, the program waits for 22 seconds (in which the result of sensing becomes stable) to confirm that a toner has been sensed.

By the above procedure, it is seen that a toner has been surely supplemented from the CTM 101 to the developing unit 106 to prepare for a recording operation, and the new CTM 101 mounted on the apparatus is full of toner. Hence, in a step S314, the inhibition LED is turned off to allow an ordinary recording operation to be executed (see FIGS. 6A and 6B). If a toner is not sensed even after the 90 seconds of supplement to the developing unit 106 as determined in the step S310, the inhibition LED responsive to the end of toner is continuously turned on or caused to flash (S315).

In the above condition, the operator can see that the new CTM 101 is empty and has to be replaced with another new CTM 101. If an empty signal is not generated in the step S308, whether or not a toner is present is continuously determined for 6 seconds to make the result of sensing sure (S316). At this instant, since a toner has already been introduced in the developing unit and the apparatus is ready to operate, the inhibition LED is turned off to allow an ordinary recording operation to be executed (S317) (see FIGS. 6A and 6B).

In summary, in accordance with the present invention, an image forming apparatus does not supplement a toner at all when operating in any one of a document image receive mode, record mode, copy mode and supervisory report record mode. This frees the operator from uneasy feelings and unpleasant noise.

Whether or not a CTM is full of toner can be accurately determined without resorting to a toner sensor otherwise included in the CTM, i.e., on the basis of a toner supplementing operation and whether or not a toner is present in a developing unit. The supplement of the CTM to the developing unit is accurately effected over a predetermined period of time only when a recording operation is under way. This insures toner supplement without giving the operator a start.

When a toner is not found in the developing unit despite the supplement from the CTM in operation, the operator is alerted to the condition wherein only a predetermined amount of toner is left in the developing unit, and then alerted to the end of toner after a predetermined number of papers have been processed by the remaining toner. Therefore, the operator is urged to replace the CTM and then inhibited from operating the apparatus after the remaining toner in the developing unit has been effectively used. In a CTM replace mode, whether or not the CTM has been set is determined. If the CTM has been set, whether or not a toner is present in the developing unit is determined. If a toner is present in the developing unit or if a toner is sensed after the supplement, the CTM replacement is followed by a record mode. If a toner is not sensed in the developing unit despite the supplement, the alert generated before the replacement of the CTM is continuously displayed, informing the operator of whether or not a new CTM is full of toner.

Various modifications will become possible for those skilled in the art after receiving the teachings of the present disclosure without departing from the scope thereof.

What is claimed is:

1. A device incorporated in an image forming apparatus for controlling supplement of a toner from supplementing means to a toner hopper included in a developing unit, said device comprising:

a toner near end sensor associated with the toner hopper for generating a toner near end signal on sensing a near end condition of the toner in the toner hopper; and control means responsive to the toner near end signal for controlling the toner supplementing means such that the toner supplementing means is operated to feed the toner to the toner hopper only while said image forming apparatus is operating in a particular mode for processing a document image.

2. A device as claimed in claim 1, wherein said particular mode comprises any one of a document image receive mode, a document image record mode, a document image copy mode, and a supervisory report record mode.

3. A device as claimed in claim 2, wherein said control means controls the toner supplementing means such that the toner is fed from said toner supplementing means to the toner hopper only when the near end signal from said toner near end sensor is being detected.

4. An image forming apparatus for supplying a fresh toner to a developing unit from a cleaner and toner magazine CTM which is a combination of a first magazine storing the fresh toner and a second magazine for collecting a used toner from a surface of a photoconductive element, said apparatus comprising:

a toner sensor for determining whether or not a toner is present in the developing unit;

decision means for determining whether or not a toner is present in the CTM on a basis of supplement of the fresh toner from said CTM and an output of said toner sensor; and control means for supplementing, when the developing unit has run out of toner during a record mode operation of said apparatus, the fresh toner from the CTM to said developing unit for a predetermined period of time, and when a recording operation ends while the supplement of the toner is under way, interrupting said supplement, memorizing a remaining time of said supplement, and resuming, at a beginning of a next recording operation, said supplement by setting said remaining time.

5. An apparatus as claimed in claim 4, wherein said decision means determines whether or not the toner is present in the CTM such that in an initialize mode of said apparatus if said CTM is mounted on said apparatus and the toner is absent in the developing unit, the fresh toner is supplemented from said CTM to the developing unit for a predetermined period of time, if a fresh toner is sensed in said developing unit after the supplement, said initialize mode is ended with the fresh toner determined to exist in said CTM, or if a fresh toner is not sensed in said developing unit, said CTM is determined to have run out of toner.

6. An apparatus as claimed in claim 5, wherein when said decision means determines that the CTM has run out of toner, an absence of toner is displayed on a display means.

7. An apparatus as claimed in claim 4, wherein said control means causes the supplement to the developing unit to occur only when the recording operation is under way.

8. An apparatus as claimed in claim 4, wherein said decision means determines whether or not the toner is present in the CTM such that when the fresh toner is not sensed in the developing unit even after said developing unit has run out of toner and the supplement of the fresh toner has been continued for a predetermined period of time, only a predetermined amount of toner is left in said developing unit.

9. An apparatus as claimed in claim 8, wherein a toner near end condition is displayed on a display means only when a predetermined amount of toner is left in the developing unit.

10. An apparatus as claimed in claim 9, further comprising control means for setting a number of papers which can be dealt with by the remaining amount of toner, decrementing said number of papers by one every time a recording operation is effected, and when said number of papers is reduced to zero, displaying an end of toner and interrupting a recording operation, whereby an operator is urged to supplement a toner by the toner near end condition while the recording operation is continued with the remaining toner.

11. An apparatus as claimed in claim 10, further comprising control means for executing a record mode if, in a CTM replace mode, a new CTM has been mounted and a toner is sensed in the developing unit or, if a fresh toner is not sensed in said developing unit even after the supplement from said CTM to said developing unit has been continued for a predetermined period of time, continuously displaying on the display means the toner near end condition or the toner end condition.

* * * * *